US006837648B1

(12) United States Patent
Wadensten

(10) Patent No.: US 6,837,648 B1
(45) Date of Patent: Jan. 4, 2005

(54) PORTABLE ROLLER-TYPE COMPACTOR APPARATUS HAVING A COMBINED MEANS FOR THE VIBRATING AND THE REVERSIBLE PROPELLING THEREOF

(76) Inventor: Theodore S. Wadensten, P.O. Box 8, 75 Stillson Rd., Wyoming, RI (US) 02898

( * ) Notice: Subject to any disclaimer, the term of this patent is extended or adjusted under 35 U.S.C. 154(b) by 0 days.

(21) Appl. No.: 10/855,845

(22) Filed: May 27, 2004

(51) Int. Cl.[7] ..... E01C 19/27
(52) U.S. Cl. ..... 404/117; 404/131; 404/133.1
(58) Field of Search ..... 404/117, 122, 404/127, 128, 131, 133.1

(56) References Cited

U.S. PATENT DOCUMENTS 1,650,574 A * 11/1927 Stubbs ..... 404/117
3,871,788 A * 3/1975 Barsby ..... 404/117
4,510,815 A * 4/1985 Baumers et al. ..... 404/117
4,647,247 A * 3/1987 Sandstrom ..... 404/75
5,439,314 A 8/1995 Wadensten
5,672,027 A 9/1997 Wadensten
6,200,066 B1 * 3/2001 Humphrey ..... 404/117

* cited by examiner

*Primary Examiner*—Gary S. Hartmann
(74) *Attorney, Agent, or Firm*—Patrick J. Pinto

(57) ABSTRACT

A manually guided roller-type compactor having a roller, a vibrator assembly, compactor frame, a drive assembly and a directional control assembly. The vibrator assembly is selectively positioned by the directional control assemble along a radial path for propelling the compactor in a forward direction or a reverse direction while simultaneously providing compacting forces. The center of the radial path is coincident with the axis of the roller rotation. The vibrator assembly may be mounted interior of the roller or alternatively exterior of the roller.

16 Claims, 7 Drawing Sheets

PORTABLE ROLLER-TYPE COMPACTOR APPARATUS HAVING A COMBINED MEANS FOR THE VIBRATING AND THE REVERSIBLE PROPELLING THEREOF

BACKGROUND OF THE INVENTION

CROSS REFERENCE TO RELATED APPLICATION

Not Applicable

STATEMENT REGARDING FEDERALLY SPONSORED RESEARCH OR DEVELOPMENT

Not Applicable

FIELD OF THE INVENTION

With regard to the classification of art, this invention is believed to be found in the general class entitled Road Structure, Process, or Apparatus and more particularly to those subclasses pertaining to compacting rollers with vibrating means.

DESCRIPTION OF RELATED ART

Portable compacting machines are well known in the prior art. Portable compacting machines include plate type compacters as well as roller type compacters. Each of these portable compacting machines employ vibration inducing mechanisms for compacting soil, rock, and paving materials. Most of the known roller type vibratory compacting machines may be classified as either manually propelled or power driven. The power driven roller compacters generally use a vibrator compacting mechanism and an independent power transmission for the propulsion thereof. Utilizing an independent power transmission adds to the cost and complexity of the roller type compactor.

It is believed that the following prior art patents may be pertinent to the present invention: U.S. Pat. No. 5,439,314 and U.S. Pat. No. 5,672,027. U.S. Pat. No. 5,439,314 issued to Wadensten on Aug. 8, 1995, disclosing a reversible plate compactor that is reversible by pivotally displacing a single vibrator housing from one end of a tamper plate to its other end. U.S. Pat. No. 5,672,027 issued to Wadensten on Sep. 30, 1997 disclosing a plate compactor that utilizes a directional control arm for displacing a single vibrator from one end of the tamper plate to the other. The two patents mentioned above are solely owned by the inventor of the present invention.

It has been found that there is a need in the industry for a roller type compactor that is lower in cost while providing a combined means for the vibrating and the reversible propelling thereof.

The present invention is an inexpensive solution for providing the needed portable roller-type compactor apparatus by having a single vibrating means for providing the compaction forces as well as the reversible propelling thereof.

SUMMARY OF THE INVENTION

The present invention may be briefly described as a portable roller-type compactor apparatus having a combined means for the vibrating and the reversible propelling thereof including: a handle member, a compactor assembly, a compactor frame, a drive assembly, and a directional control assembly. The handle member is attached to a selected portion of the compactor frame for the manual guiding and manipulation thereof.

The compactor assembly includes an elongated roller and a vibrator assembly. The elongated roller is removably retained on a roller shaft. The roller shaft is elongated and has extending portions that extend a selected length beyond each of the opposing end caps of the elongated roller for allowing removable attachment thereof to the compactor frame by a resilient mounting assembly. The elongated roller is simultaneously rotatable with respect to the compactor frame. The vibrator assembly includes a weight that is eccentrically mounted on a portion of the vibrator shaft between a pair of mounting arms for imparting vibratory motion during rotation of the vibrator shaft by a driven member also mounted thereon. The vibrator shaft is of a sufficient length for allowing the journaling thereof in and by a first end of each of the mounting arms. A second end of each of the mounting arms is mounted on selected portions of the roller shaft for allowing the weight and vibrator shaft to pivotally travel along a radial path while simultaneously providing a predetermined clearance with respect to an outer diameter of the elongated roller during rotation of the vibrator shaft. The radial path has its center at the axis of the roller shaft while being simultaneously concentric with the outer diameter.

The drive assembly includes: a drive motor, a driving member and a power transmitter. The drive motor is removably mounted on the compactor frame. The drive motor has a driving member secured to its drive shaft. The power transmitter is configured for transmitting torque from the driving member to the driven member.

The directional control assembly has a grasping end for providing selective manual control of the placement of the vibrator shaft and weight along the radial path. The directional control assembly is selectively positioned for moving the vibrator assembly and the driven member along the radial path so that the vibrator assembly and the driven member are positioned near a first selected angular position for propelling the compacting roller in a first direction of travel while simultaneously providing compacting forces thereto and subsequently propelling the compacting roller in a second direction of travel while simultaneously providing compacting forces to the elongated roller by selectively pivoting of the vibrator assembly and the driven member to a second angular position by and with the directional control assembly.

The vibrator assembly may be either placed exterior of the roller diameter or interior of the roller diameter.

In addition to the above summary, the following disclosure is intended to be detailed to insure adequacy and aid in the understanding of the invention. However, this disclosure, showing particular embodiments of the invention, is not intended to describe each new inventive concept that may arise. These specific embodiments have been chosen to show at least one preferred or best mode for a roller-compactor of the present invention. These specific embodiments, as shown in the accompanying drawings, may also include diagrammatic symbols for the purpose of illustration and understanding.

Figure 1:
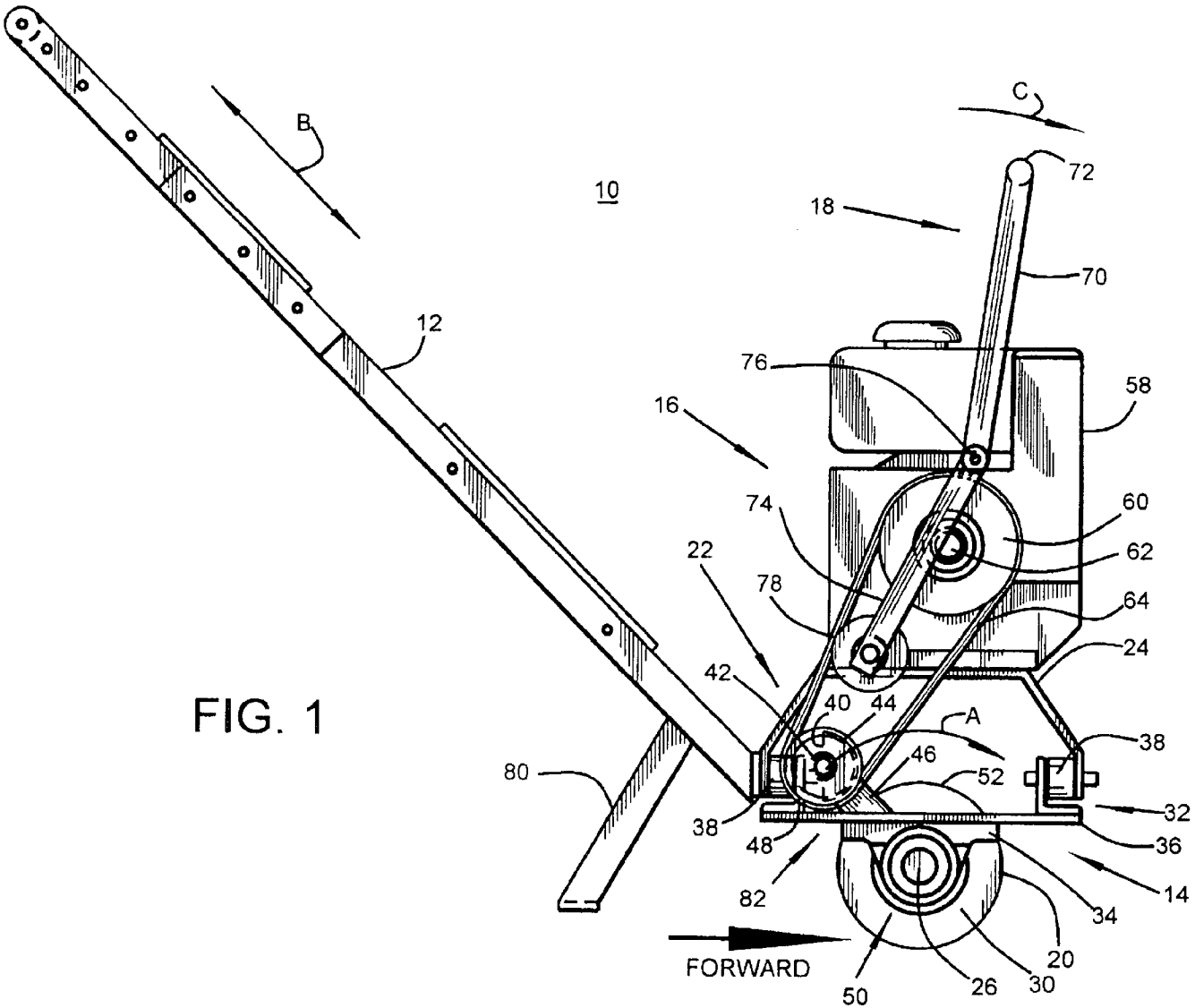
FIG. 1 represents a front elevation of the present invention being used on a roller compactor having a vibrator assembly exterior of its compacting roller, this view showing the position of the external vibrator assembly for movement in a forward direction.

In the following description and in the appended claims, various details of the invention are identified by specific names for convenience. These names are intended to be generic in their application while differentiating between the various details. The corresponding reference numbers refer to like members throughout the several figures of the drawing.

The drawings accompanying and forming a part of this specification disclose details of construction for the sole purpose of explanation. It is to be understood that structural details may be modified without departing from the concept and principles of the invention as claimed. This invention may be incorporated into other structural forms than shown.

DETAILED DESCRIPTION OF THE INVENTION AN EXTERNAL VIBRATOR ASSEMBLY

Referring first to FIGS. 1 through 4, a first embodiment of the roller type compactor of the present invention is generally identified as 10. This roller type compactor 10 includes a handle member 12, a compactor assembly 14, a drive assembly 16 and a directional control assembly 18.

The compactor assembly 14 includes an elongated roller 20, vibrator assembly 22, and a compactor frame 24. The elongated roller 20 is removably retained on an elongated roller shaft 26 by and with a conventional and suitable retaining means such as a setscrew arrangement, clamp type hub and the like but not limited thereto. The roller shaft 26 has extending portions 28, shown more clearly in FIG. 3, that extend a selected length beyond each of the opposing end caps 30 of the roller 20. A resilient mounting assembly 32 removably attaches each extending portion 28 of the roller shaft 26 to a compactor frame 24. In this embodiment, each resilient mounting assembly 32 includes at least two pillow block bearings 34, a roller frame 36, and a plurality of rubber shocks or isolators 38. Preferably, the roller frame 36 is windowed for allowing the roller 20 to rotate therein. The window in the roller frame 36 may be seen more clearly in FIG. 4. The pillow block bearings 34 are removably mounted to the roller frame 36 by threaded fasteners. The roller shaft 26 is securely retained by the pillow block bearings 34 by a suitable and conventional retaining means for minimizing unwanted axial movement of the roller shaft 26 with respect to the pillow block bearings 34. Some non-limiting examples of a conventional retaining means for the roller shaft 26 are retaining rings, setscrew collars, split collars and the like. It is to be noted that the roller 20 may include bearings that are mounted in its end caps 30 for allowing relative rotary motion between the roller 20 and it's shaft 26.

A vibrator assembly 22 includes an eccentric weight or mass 40, a vibrator shaft 42, and a pair of mounting arms 46. The vibrator shaft 42 is of a selected length for allowing journaling in a first end 44 of each of the mounting arms 46. At least one end of the vibrator shaft 42 extends a selected distance beyond one of the mounting arms 46 for allowing the removable mounting of a driven member 48 thereon. One non-limiting example of a driven member 48 is a V-belt pulley. Some non-limiting examples of a removable mounting for the driven member 48 to the vibrator shaft 42 are keys that are combined with either a setscrew or a clamp type hub. A second end 50 of each of the mounting arms 46 is removably and pivotally mounted on the roller shaft 26 between the end caps 30 and the pillow block bearings 34 for allowing the weight 40 and the vibrator shaft 42 to travel along a radial path that is indicated by an arrow A, shown in FIGS. 1 and 2. The radial path A is exterior of the outer diameter 52 of the roller 20. The radius of the radial path A, is the distance between the axis of the roller shaft 26 and the axis of the vibrator shaft 42. This radius provides a selected and predetermined clearance between the weight 40 and the outer diameter 52 of the roller 20 when and while the driven member 48 rotates the vibrator shaft 42 and weight 40. The radial path A is therefore substantially concentric with the outer diameter 52.

The drive assembly 16 includes a drive motor 58 that is removably mounted to the compactor frame 24. The term drive motor 58 within the context of this application may include internal combustion engines, electric motors, pneumatic motors and hydraulic motors, etc. A drive member 60 is mounted on the output shaft 62 of the drive motor 58. It is preferred that a conventional centrifugal clutch, not shown, be used for mounting the drive member 60 to the output shaft 62 so that the drive member 60 does not rotate when the drive motor 58 is running at idle speed. A power transmitter 64 transmits power from the drive member 60 to the driven member 48. In this first embodiment of the present invention the power transmitter 64 should be a flexible driving member. Some non-limiting examples of a flexible driving member for the power transmitter 64 are: V-belts, timing belts, roller chains, link type belts and the like. Of course the drive member 60 and the driven member 48 must be compatible with the flexible driving member.

Still referring to FIGS. 1 through 4, the directional control assembly 18 of this first embodiment includes a direction control arm 70 that has a grasping end 72, an engaging end 74, and a center of rotation 76. The engaging end 74 is distal to the grasping end 72 and has an engaging member 78 journalled thereon. The center of rotation 76 is selectively positioned with respect to the grasping end 72 and the engaging end 74. The center of rotation 76 is arrayed for pivotally attaching said direction control arm 70 to a selected portion of the drive assembly 16 so that the engaging member 78 is positioned between the drive member 60 and the driven member 48. The engaging member 78 being also positioned for selectively engaging the interior surface of one of a pair strands of the suitable power transmitter 64. The power transmitter 64 preferably has a selected pitch length that will support the vibrator assembly 22 at either the first angular position 82 or the second angular position 84 while maintaining a suitable driving tension on the power transmitter 64

USE AND OPERATION OF THE FIRST EMBODIMENT

Referring now in particular to FIG. 1. In operation, the operator pivots the directional control arm 70 in the direction of arrow C about the center of rotation 76 for engaging and urging a left side strand of the flexible drive member 64 by and with the engaging member 78 while simultaneously maintaining engagement of the flexible drive member 64 with the drive member 60 and the driven member 48. The urging of the left side strand of the power transmitter 64 or flexible drive member causes the vibrator assembly 22 and the driven member 48 to pivot about the axis of the roller shaft 26 so that the vibrator assembly 22 is positioned at or near a first angular position 82 with respect to an imaginary vertical line passing through the axis of the roller shaft 26. Driving tension is maintained by the weight of the vibrator assembly being supported by the flexible drive member 64. The operator then increases the RPM of the drive motor 58 by a conventional throttle control, not shown, for engaging the centrifugal clutch of the drive member 60. The first position 82 of the vibrating vibrator assembly 22 propels the compactor 10 in a first or forward direction of travel, toward the right of the drawing, while simultaneously providing compacting forces thereto.

Figure 2:
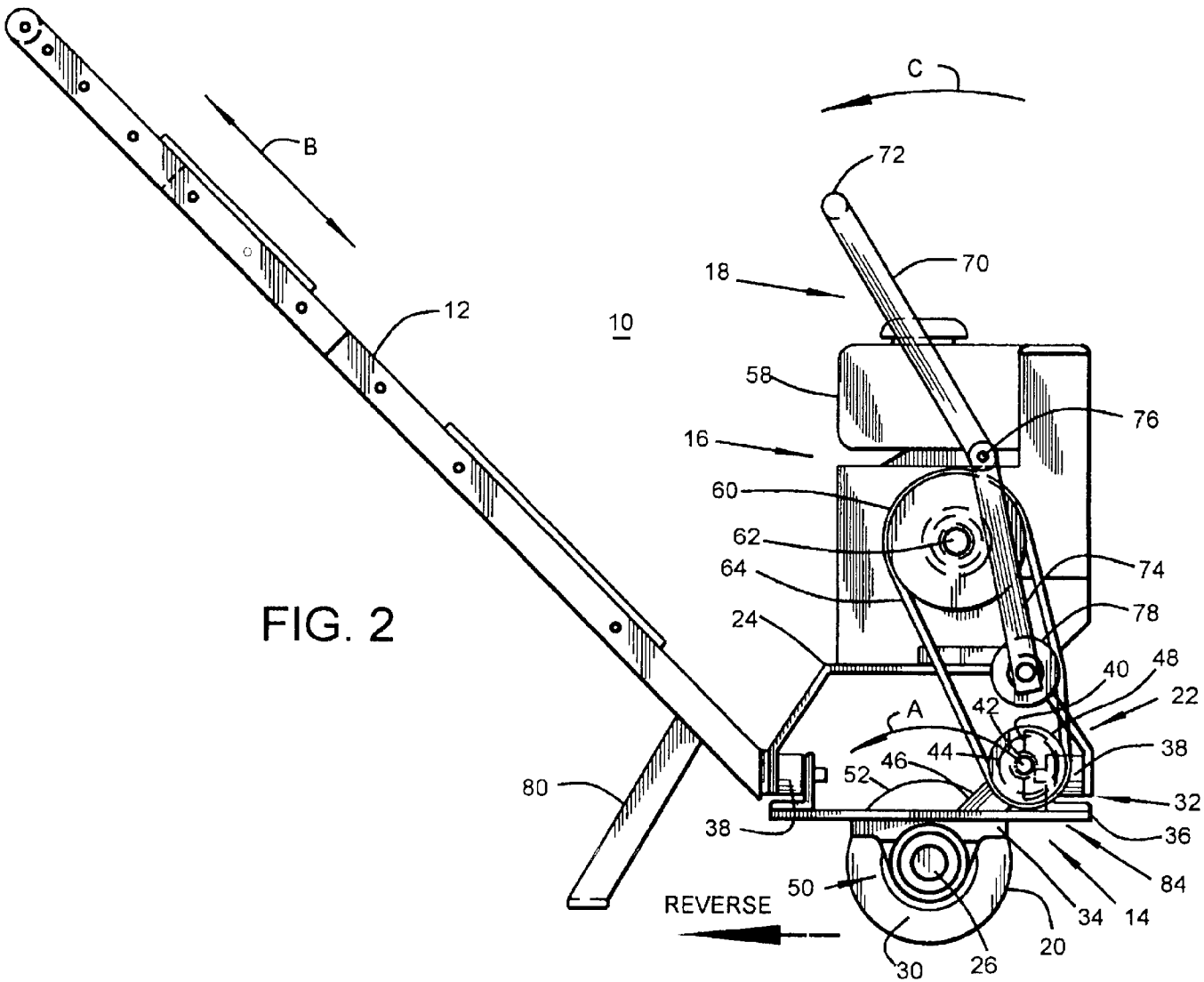
FIG. 2 represents a front elevation of the compactor of FIG. 1, this view showing the position of the vibrator assembly for movement in a reverse direction.
Figure 3:
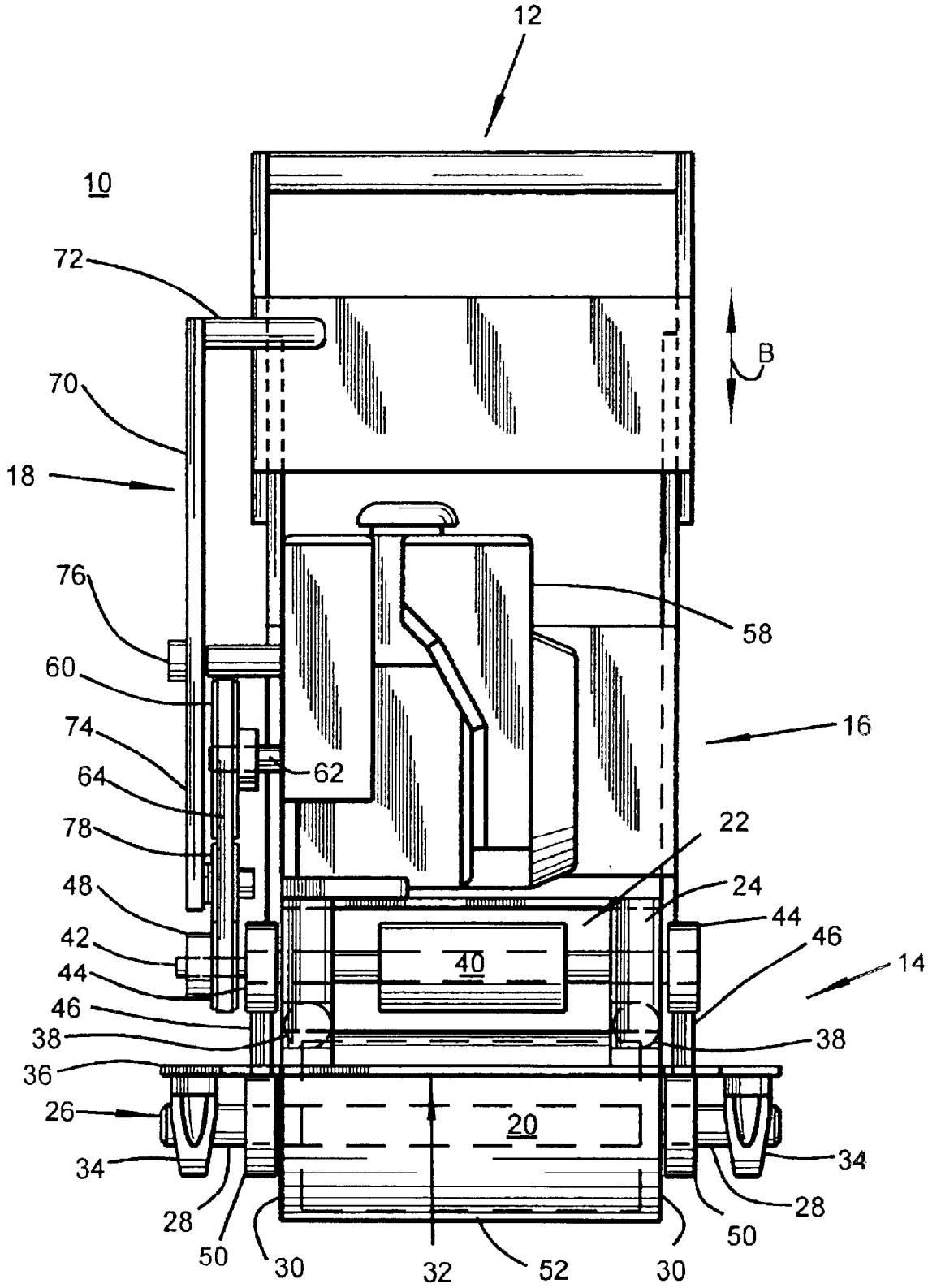
FIG. 3 represents a right side elevation of the compactor of FIG. 1.
Figure 4:
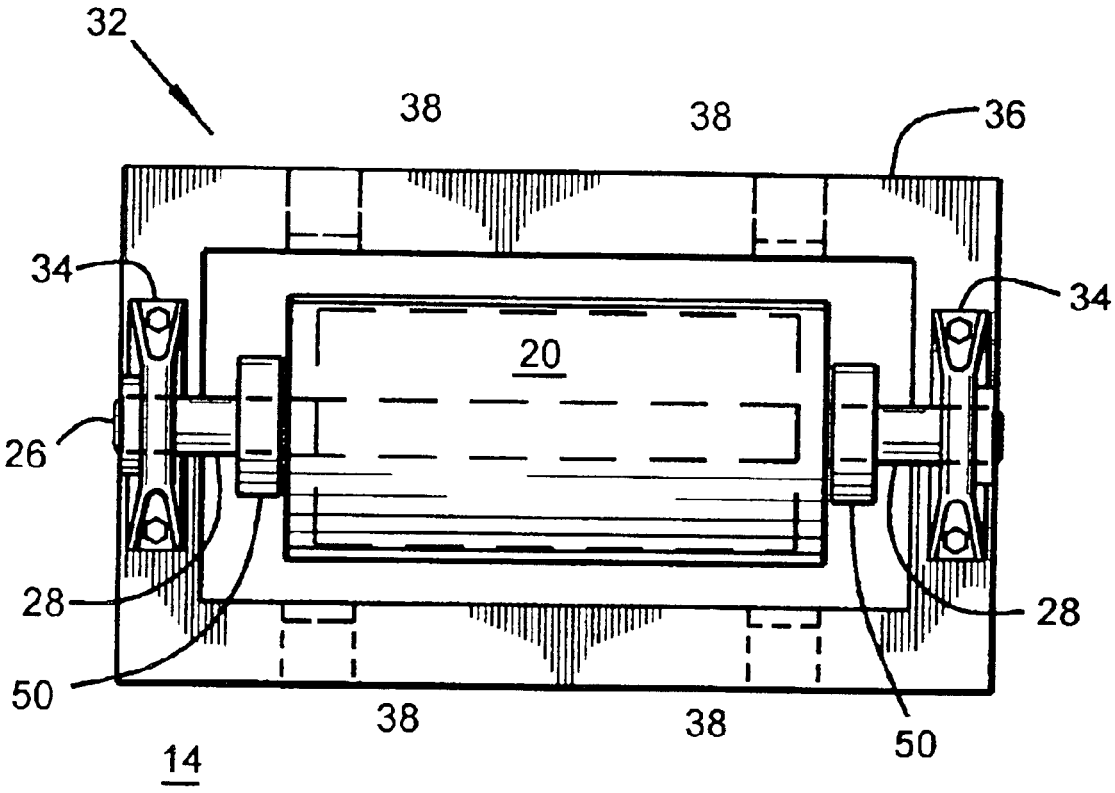
FIG. 4 represents a bottom plan view of the compactor of FIG. 1.

Referring now in particular to FIG. 2. The operator selectively pivots the directional control arm 70 in a direction opposite to that shown in FIG. 1 for reversing the direction of travel of the compactor. The movement in the opposite direction, as shown by arrow C, moved the vibrator assembly 22 to a second angular position 84 with respect to an imaginary vertical line passing through the axis of the roller shaft 26. The operator then again increases the RPM of the drive motor 58 by a conventional throttle control, not shown, for engaging the centrifugal clutch of the drive member 60. This movement to second position 84 by and with the engaging member 78 propels the compacting roller in a reverse or second direction of travel, toward the left side of the drawing, while simultaneously providing compacting forces thereto.

It is to be noted that the handle member 12 that is mounted to the compactor frame 24 should include a leg member 80 that may be used as a rest when the roller compactor 10 is not in use. It is also preferred that the handle member 12 be telescopically adjustable in the direction of arrow B. This adjustment would allow compensation for a comfortable operating position for the user. It is also preferred that roller compactor 10 be operated with the drive motor mounting surface of the compactor frame 24 in a substantially horizontal attitude for maintaining uniform compacting forces.

INTERNAL VIBRATOR ASSEMBLY

Figure 5:
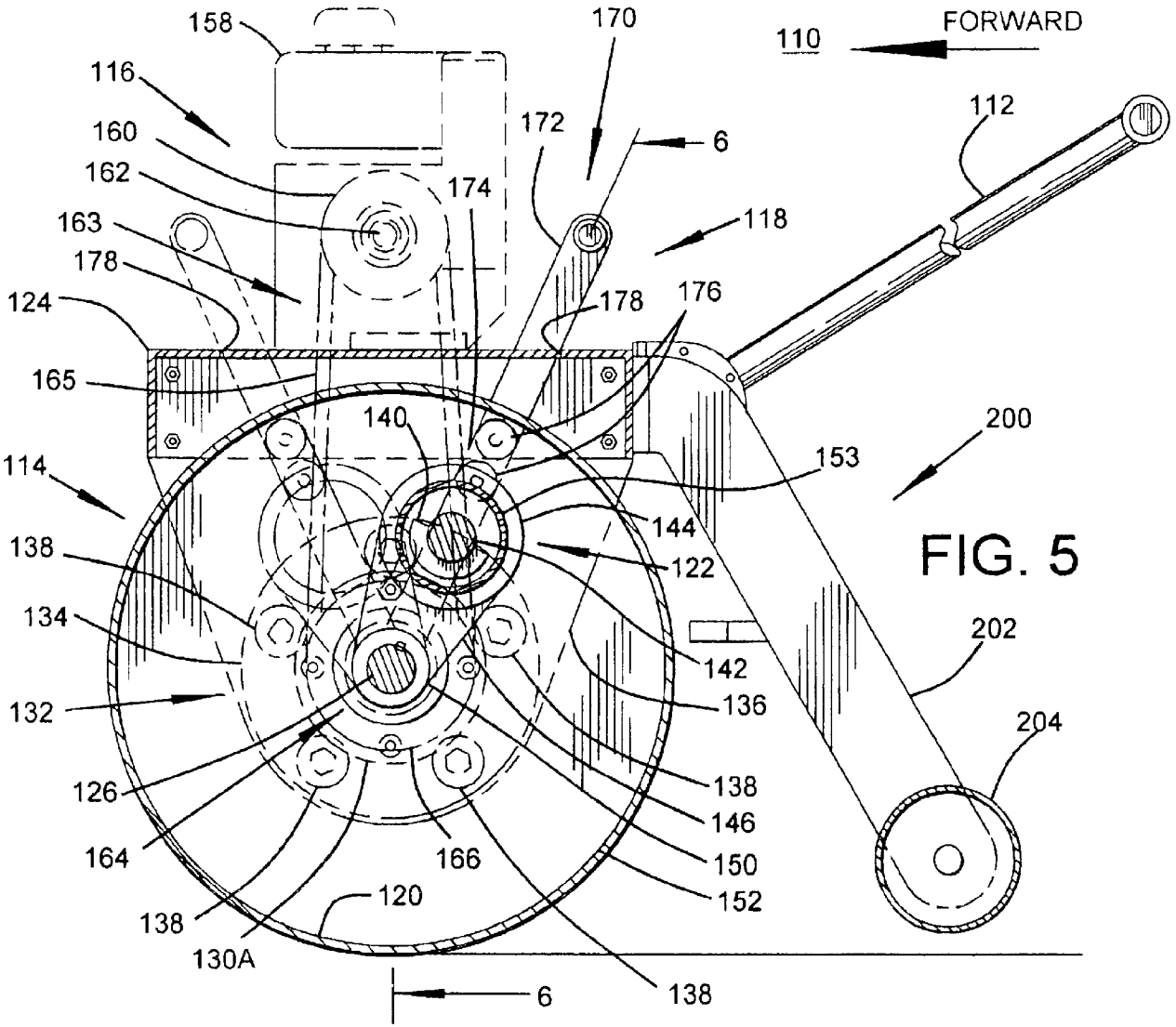
FIG. 5 represents a front sectional elevation of a second embodiment of a roller compactor of the present invention having a vibrating assembly housed interior of the roller. A first type of directional control assembly selectively positions the vibrator assembly.
Figure 6:
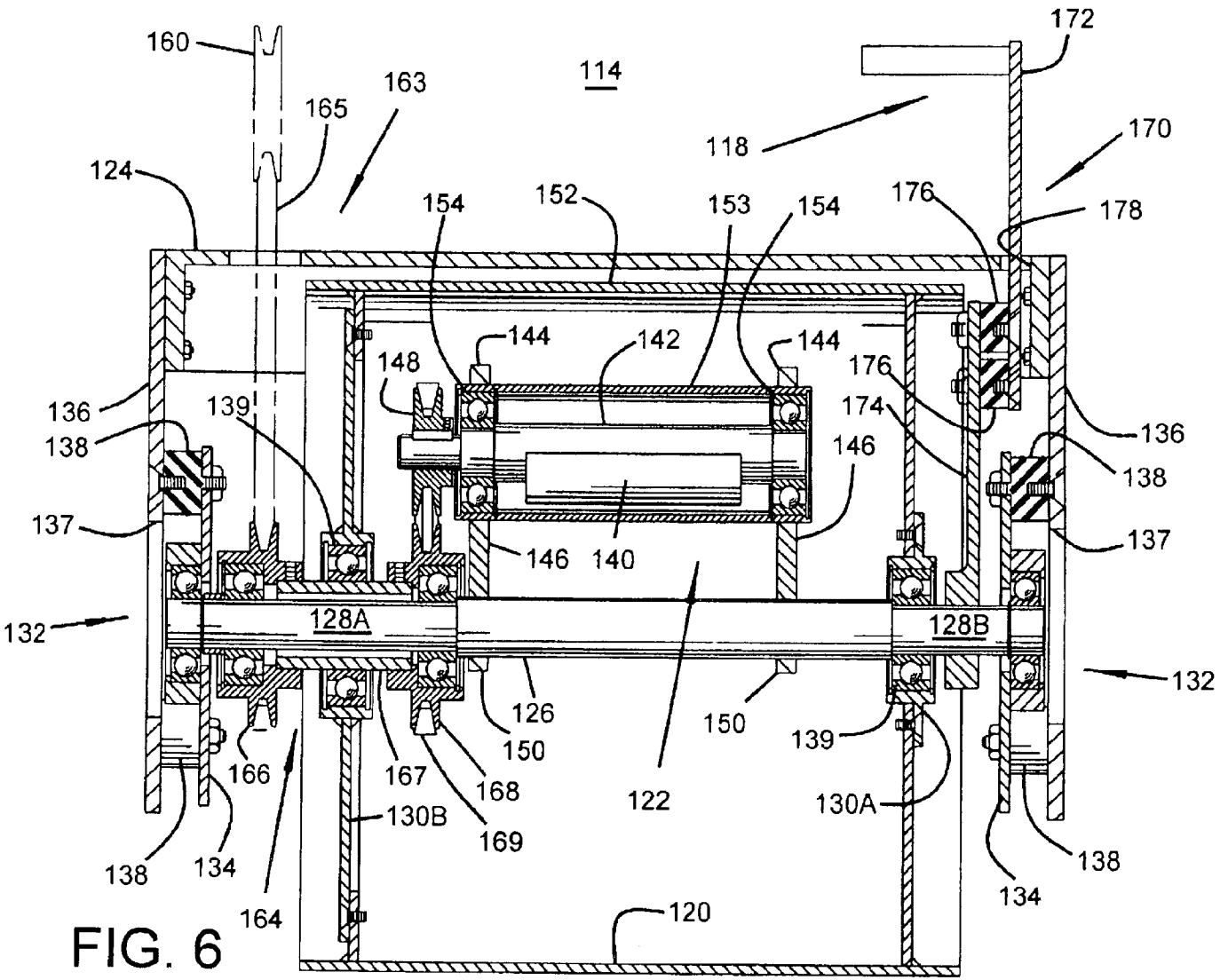
FIG. 6 represents a side sectional view of the embodiment of FIG. 5, this view being taken along line 6—6 of FIG. 5.

Referring now to FIGS. 5 and 6 this second embodiment of a roller type compactor of the present invention is generally identified as 110. This second embodiment 110 includes: a handle member 112, a compactor assembly 114, a drive assembly 116 and a directional control assembly 118.

The compactor assembly 114 includes an elongated roller 120, a vibrator assembly 122, and a compactor frame 124. The elongated roller 120 is removably retained on an elongated roller shaft 126 by and with a conventional and suitable retaining means such as shouldered portions, retaining rings, clamp collars and the like but not limited thereto. The roller shaft 126 has reduced diameter extending portions 128A & 128B that extend a selected length beyond each of the opposing end caps 130A & 130B of the roller 120. The extending portions 128A & 128B may be more clearly seen in FIG. 6. The roller shaft 126 is removably attached to a compactor frame 124 by a pair of resilient mounting assemblies 132. In this embodiment, each of the resilient mounting assemblies 132 includes an anti-friction bearing assembly 134, a roller support 136, and a plurality of rubber shocks or isolators 138 that are removably mounted between the bearing assembly 134 and the roller support 136. Preferably, the roller supports 136 include clearance windows 137 for allowing relative movement between the bearing assembly 134 and the roller support 136. The window 137 in the roller frame 136 may be seen more clearly in FIG. 6. The roller shaft 126 is securely retained to the bearing assemblies 134 by a suitable and conventional retaining means for minimizing unwanted axial movement of the roller shaft 126 with respect to the bearing assemblies 134. Some non-limiting examples of a conventional retaining means for the roller shaft 126 are retaining rings, setscrew collars and the like. It is preferred that the roller 120 be journalled to the shaft 126 by bearings 139 that are mounted in the end caps 130A & 130B for allowing relative rotary motion between the roller 120 and it's shaft 126.

A vibrator assembly 122 includes an eccentric weight or mass 140, a vibrator shaft 142, and a pair of mounting arms 146. The vibrator shaft 142 is of a selected length for allowing journaling at a first end 144 of each of the mounting arms 146. At least one end of the vibrator shaft 142 extends a selected distance beyond one of the mounting arms 146 for allowing the removable mounting of a driven member 148 thereon. One non-limiting example of a driven member 148 is a V-belt pulley. Some non-limiting examples of a removable mounting for the driven member 48 to the vibrator shaft 42 are keys that are combined with either a setscrew or a clamp type hub. A second end 150 of each of the mounting arms 146 is removably secured to and on the roller shaft 126 interior of the roller 120 for allowing the axis of the vibrator shaft 142 to travel along a radial path A. The radial path A is interior of the outer diameter 152 of the roller 120. As noted above in connection with FIGS. 1 and 2, the radius of the radial path A, is measured between the axis of the roller shaft 126 and the axis of the vibrator shaft 142. The radial path A provides a selected and predetermined clearance between the weight 140 and the outer diameter 152 of the roller 20 when and while the driven member 148 rotates the vibrator shaft 142 and weight 140 mounted thereon. The radial path A is therefore substantially concentric with the outer diameter 152. The vibrator assembly 122 of this second embodiment includes a housing 153 that extends between the first end 144 of the mounting arm 146 and has anti-friction bearings 154 mounted therein for journaling the shaft 142.

The drive assembly 116 includes a drive motor 158 that is removably mounted to the compactor frame 124 by suitable fasteners. The drive motor 158 is shown in dashed outline in FIG. 5 and FIG. 7 and is similar to the one described above in connection with FIGS. 1 through 4. As noted above, the term drive motor 158 within the context of this application may include internal combustion engines, electric motors, pneumatic motors and hydraulic motors, etc. A drive member 160 is mounted on the output shaft 162 of the drive motor 158. It is preferred that a conventional centrifugal clutch, not shown, be used for mounting the drive member 160 to the output shaft 162 so that the drive member 160 does not rotate when the drive motor 158 is running at a selected idle speed. A power transmitter array 163 transmits power from the drive member 60 to the driven member 148 by way of an Idler cluster assembly 164. The idler cluster assembly 164 is journalled on the reduced diameter portion of the shaft 126. The idler cluster assembly 164 includes a first intermediate driven member 166 that is connected by an elongated torque tube 167 to an intermediate drive member 168. The first intermediate driven member 166 and the intermediate drive member 168 are removably mounted on the opposite ends of the torque tube 167 by a suitable means such as key and setscrew arrangement, but not limited thereto. The end cap 130B is removably fastened to its respective end of the roller 120 and is journalled on the torque tube 167 intermediate the first intermediate driven member 166 and the intermediate drive member 168. The drive member 160 drives a first intermediate driven member 166 by way of the first intermediate power transmitter 165. Intermediate drive member 168 drives the driven member 148 by way of a second intermediate power transmitter 169. In the embodiment of the present invention the power transmitter array 164 should include flexible driving members for the first intermediate power transmitter 165 and the second intermediate power transmitter 169. Some non-limiting examples of a flexible driving member for the first and second power transmitters 165 and 169 are: V-belts, timing belts, roller chains, link type belts and the like. It is to be noted that it is preferred that the end cap 130A be removably fastened to its respective end of the roller 120 for ease of assembly and service.

Referring in particular to FIG. 5 and FIG. 6, the directional control assembly 118 of this alternate embodiment includes a shift arm assembly 70 that has a grasping member or end 172, and a shaft attachment member 174. The shaft attachment end 174 is removably secured to the shaft 126 by a suitable means. In this embodiment it is preferred that the shaft attachment member 174 be in substantial angular alignment with the mounting arms 146 so that the operator can visibly determine the angular position of the vibrator assembly 122. The grasping member 172 is connected to the shaft attachment member 174 by and with a pair of resilient shock mounts or vibration isolators 176 for minimizing the transmission of vibration into the grasping end or member 172. The grasping member 172 extends a selected distance through an elongated aperture 178 that is formed in the top surface of the compactor frame 124. The operator selectively moves the shift arm assembly 170 to and towards the handle member 112 end of the elongated aperture 178 which in turn pivots the vibrator assembly 122 along its radial path to a first angular position 82 for impelling the roller compactor 110 in the forward direction, as noted in FIG. 5. The roller compactor's 110 direction of travel may be reversed from the forward direction of travel by moving the vibrator assembly 122 to a second angular position 84 by moving the shift arm assembly 170 to the distal end of the elongated aperture 178. As noted above, the first angular position 82 is measure with respect to an imaginary vertical line passing through the axis of the roller shaft 126. Similarly, the second angular position 84 is measured with respect to an imaginary vertical line passing through the axis of the roller shaft 126.

Figure 7:
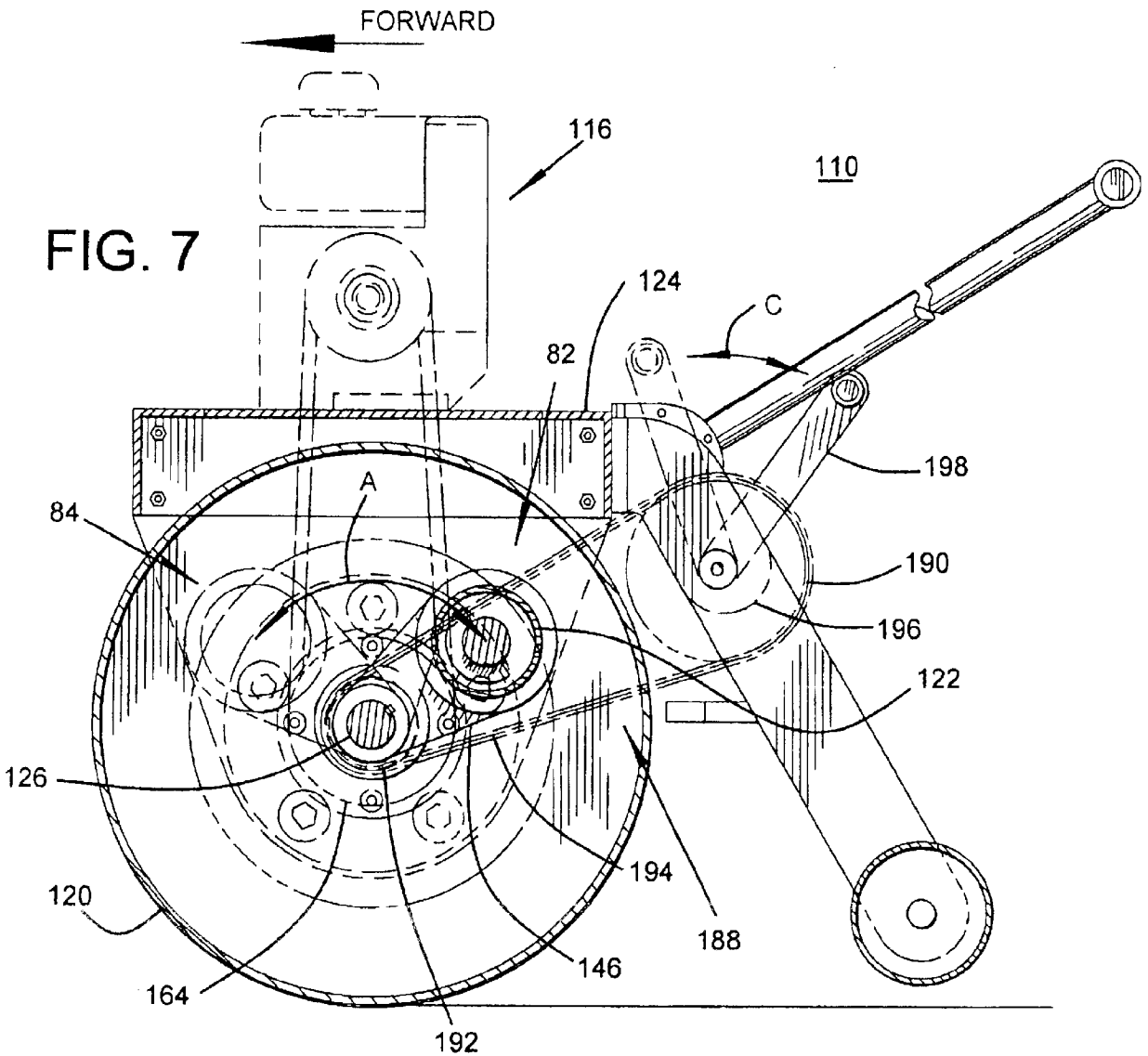
FIG. 7 represents a front sectional elevation of the roller compactor of the present invention having a vibrating assembly housed interior of the roller as in FIG. 5. A second type of directional control assembly selectively positions the vibrator assembly.

An alternate arrangement for controlling the directional travel of the roller compactor 110 is shown in FIG. 7 and is generally identified as 196. In this alternate arrangement the shift arm assembly 170 is replaced by rotary drive assembly that is generally identified as 188. Some non-limiting examples of a rotary drive assembly 188 are timing belt and pulleys, roller chain and sprockets, gear belts and gear pulleys and the like. Preferably, the rotary drive assembly 188 includes a reduction ratio between its driver element 190 and its driven element 192 with a continuous flexible drive 194 meshing there with. The driven element 192 is removably mounted to the extending portion 128B of the shaft 126 replacing the shaft attachment member 174 of FIG. 6. The driver element 190 is pivotally mounted to a selected portion of the compactor assembly 124 by a suitable bracket member 196. A control handle 198 is attached to the driver member 190 and is used for manually imparting limited pivotal motion thereto. The selective manual positioning of the vibrator assembly 122 between the first angular position 82 and the second angular position 84 is controllable by the operator by moving the handle 198 accordingly. The roller compactor 110 will move in the forward direction when the vibrator assembly 122 is moved in a direction of the first angular position 82. The roller compactor 110 will move in a reverse direction when the vibrator assembly 122 is moved toward the second angular position 84. It is anticipated that other directional control assemblies, such as gear trains, flexible shafts, linear actuators and the like, may be used for moving the vibrator assemblies along its radial path.

It is to be further noted that the direction of travel of the roller compactors of the present invention may be shifted or reversed from its current direction of travel while the weight 40 or 140 of the vibrator assembly 22 or 122 is rotating since there is no change made to its direction of rotation. It is to be also noted that the weight 40 and shaft 42 of compactor 10 may be enclosed within a housing member that is similar to housing 153 of FIG. 6.

Referring again to FIG. 5, the compactor frame 124 should include a rest assembly 200 that may be used as a support when the roller compactor 110 is not in use. The rest assembly 200 shown in FIGS. 5 and 7 include at least one leg 202 and at least one wheel 204, but other types of suitable rest assemblies 200 may be used.

In the embodiments described above, it has been found that the best combination of speed and compaction forces is within the range of 55 angular degrees and 75 angular degrees for the first angular position 82 and the second angular position 84. As previously mentioned, the first angular position 82 and the second angular position 84 is measure with respect to an imaginary vertical line passing through the axis of either roller shaft 26 or 126.

Directional terms such as "front", "back", "in", "out", "downward", "upper", "lower" "left" "right" and the like may have been used in the description. These terms are applicable to the embodiments shown and described in conjunction with the drawings. These terms are merely used for the purpose of description in connection with the drawings and do not necessarily apply to the position in which the present invention may be used.

While these particular embodiments of the present invention have been shown and described, it is to be understood that the invention is not limited thereto and protection is sought to the broadest extent that the prior art allows.

What is claimed is:

1. A portable roller-type compactor apparatus having a combined means for the vibrating and the reversible propelling thereof including:

a) a handle member being attached to a selected portion of the compactor apparatus for manually guiding and manipulation thereof;

b) a compactor assembly having an elongated roller, a vibrator assembly, and a compactor frame, said elongated roller being removably retained on a roller shaft; the roller shaft being elongated and having extending portions that extend a selected length beyond each of the opposing end caps of the elongated roller for allowing removable attachment thereof to the compactor frame by and with at least one resilient mounting assembly; the elongated roller being simultaneously rotatable with respect to the compactor frame; the vibrator assembly including a weight being eccentrically mounted on a vibrator shaft between a pair of mounting arms, for imparting vibratory motion during rotation of said vibrator shaft by a driven member also mounted thereon, said vibrator shaft being of a sufficient length for allowing the journaling thereof in and by a first end of each of the mounting arms, a second end of each of the mounting arms being mounted on selected portions of the roller shaft for allowing the weight and vibrator shaft to pivotally travel along a radial path, the radial path providing a predetermined clearance of the vibrator assembly with respect to an outer diameter of the elongated roller during rotation of the vibrator shaft, the radial path having its center at the axis of the roller shaft while being simultaneously concentric with the outer diameter;

c) a drive assembly including; a drive motor, a driving member, and a power transmitter array; the drive motor being removably mounted on the compactor frame, the driving member being secured on a drive shaft of the drive motor, the power transmitter array for transmitting power from the driving member to the driven member;

d) a directional control assembly having a grasping end for providing selective manual control of the placement of the vibrator shaft and weight along the radial path;

wherein, the directional control assembly is selectively positioned for moving the vibrator assembly and the driven member along the radial path so that the vibrator assembly and the driven member are positioned near a first selected angular position for propelling the elongated roller in a first direction of travel while simultaneously providing compacting forces thereto and propelling the elongated roller in a second direction of travel while simultaneously providing compacting forces to the elongated roller by selectively pivoting of the vibrator assembly and the driven member to a second angular position by and with the directional control assembly.

2. A portable roller type compactor as recited in claim 1 wherein the radial path is exterior of the outer diameter of the elongated roller.

3. A portable roller type compactor as recited in claim 1 wherein the radial path is interior of the outer diameter of the elongated roller.

4. A portable roller type compactor as recited in claim 2 wherein the directional control assembly includes a direction control arm including the grasping end, an engaging end; and a center of rotation, the engaging end being distal to the grasping end and having an engaging member attached thereto; said center of rotation being selectively positioned with respect to the grasping end and the engaging end; said center of rotation being arrayed for pivotally attaching said direction control arm to a selected portion of the drive assembly so that the engaging member is positioned between the drive member and the driven member; and said power transmitter array is a flexible drive member, said engaging means being also positioned for selectively engaging one of a pair strands of the flexible drive member that is transmitting rotary motion from the driving member to the driven member.

5. A portable roller type compactor as recited in claim 4 wherein the flexible drive member is a drive belt; the drive member is a drive pulley; the driven member is a driven pulley and the engaging member is an idler pulley.

6. A portable roller type compactor as recited in claim 5 wherein the drive belt has a selected pitch length for supporting the vibrator assembly at the selected first angular position or the second angular position.

7. A portable roller type compactor as recited in claim 6 wherein a drive tension of the drive belt is maintained while the drive belt is supporting the vibrator assembly.

8. A portable roller type compactor as recited in claim 3 wherein the driving member of the drive assembly is exterior of the elongated roller and the driven member of the vibrator assembly is interior of the elongated roller, the power transmitter array includes an idler cluster assembly that is journalled on a selected portion of the roller shaft for providing the rotation of the driven member of the vibrator assembly by the driving member of the drive assembly.

9. A portable roller type compactor of claim 8 wherein the idler cluster assembly includes a first intermediate driven member, a torque tube, and an intermediate drive member; the first intermediate driven member and the intermediate drive member being removably mounted and retained in a selected spaced relationship on opposite ends of the torque tube, and one of the end caps of the elongated roller is journalled on the torque tube intermediate the first intermediate driven member and the intermediate drive member.

10. A portable roller type compactor as recited in claim 9 wherein the power transmitter array further includes a first intermediate power transmitter and a second intermediate power transmitter, the drive member driving the first intermediate driven member of the idler cluster by way of the first intermediate power transmitter and the intermediate drive member of the idler cluster driving the driven member of the vibrator assembly by the second intermediate power transmitter.

11. A portable roller type compactor as recited in claim 10 wherein flexible drive members are used for the first intermediate power transmitter and the second intermediate power transmitter.

12. A portable roller type compactor as recited in claim 10 wherein flexible belts are used for the first intermediate power transmitter and the second intermediate power transmitter.

13. A portable roller type compactor as recited in claim 3 wherein the directional control assembly includes a shift arm assembly that is removable retained on the a selected portion of the roller shaft.

14. A portable roller type compactor as recited in claim 13 wherein the shift arm assembly is in a predetermined alignment with the mounting arms for providing a visual indication of the position of the vibratory assembly.

15. A portable roller type compactor as recited in claim 13 wherein the shift arm assembly further includes a shaft attachment member and at least one resilient shock mount for connecting the grasping end to the shaft attachment member.

16. A portable roller type compactor as recited in claim 14 wherein the shift arm assembly includes a shaft attachment member and at least one resilient shock mount for connecting the grasping end to the shaft attachment member.

* * * * *